US010174543B2

(12) United States Patent
Kapavik

(10) Patent No.: US 10,174,543 B2
(45) Date of Patent: Jan. 8, 2019

(54) POCKET DOOR SYSTEM

(71) Applicant: Rodney Kapavik, Enis, TX (US)

(72) Inventor: Rodney Kapavik, Enis, TX (US)

( * ) Notice: Subject to any disclaimer, the term of this patent is extended or adjusted under 35 U.S.C. 154(b) by 223 days.

(21) Appl. No.: 15/204,086

(22) Filed: Jul. 7, 2016

(65) Prior Publication Data

US 2018/0010380 A1 Jan. 11, 2018

(51) Int. Cl.

| | |
|---|---|
| ***E06B 3/46*** | (2006.01) |
| ***E06B 9/04*** | (2006.01) |
| ***E05D 15/06*** | (2006.01) |
| ***E05B 65/08*** | (2006.01) |
| ***E05B 63/24*** | (2006.01) |
| ***E05B 65/00*** | (2006.01) |
| *E06B 9/00* | (2006.01) |

(52) U.S. Cl.

CPC ..... *E06B 3/4654* (2013.01); *E05B 63/248* (2013.01); *E05B 65/0007* (2013.01); *E05B 65/0864* (2013.01); *E05D 15/0665* (2013.01); *E05D 15/0691* (2013.01); *E06B 9/04* (2013.01); *E06B 2009/002* (2013.01)

(58) Field of Classification Search

CPC ..... E06B 3/4654; E06B 9/04; E05Y 2900/14; E05Y 2900/142; E05B 65/0007; E05B 65/0864; E05B 63/248; E05D 15/0665; E05D 15/0691

See application file for complete search history.

(56) References Cited

U.S. PATENT DOCUMENTS 2,275,089 A * 3/1942 Pirtz ..... E05B 65/0811 292/106
2,613,076 A * 10/1952 Bassett ..... E05F 15/649 200/61.71
2,632,925 A * 3/1953 Long ..... E06B 3/4654 16/92
2,632,926 A * 3/1953 Haley ..... E05D 15/14 16/92
2,834,069 A * 5/1958 Perrone ..... E06B 3/4654 16/106
3,058,174 A 10/1962 Sterling
3,214,948 A * 11/1965 Modrey ..... E05B 63/127 292/106
3,400,490 A * 9/1968 Anderson ..... E05D 15/06 49/372
3,480,989 A 12/1969 Edeus
4,050,189 A * 9/1977 Peterson ..... E05D 15/06 318/285
4,063,389 A * 12/1977 Leder ..... E05B 65/0864 49/370
4,125,966 A * 11/1978 Penn ..... E05F 15/649 49/349

(Continued)

FOREIGN PATENT DOCUMENTS

WO WO1998029627 7/1998

*Primary Examiner* — Justin B Rephann

(57) ABSTRACT

A pocket door system for inhibiting an animal from passing through a doorway includes a door frame is positioned within a wall. A door unit is slidably positioned within the wall. The door unit is biased into a closed position having the door unit extending across the door frame. Thus, the door unit may inhibit an animal from passing through the door frame. The door unit is selectively urged into an open position. Thus, the door unit facilitates the animal to pass through the door frame.

13 Claims, 4 Drawing Sheets

(56) References Cited

U.S. PATENT DOCUMENTS

| | | | | |
|---|---|---|---|---|
| 4,370,831 | A * | 2/1983 | Hamilton | H05K 9/0015 174/375 |
| 5,367,829 | A | 11/1994 | Crossley et al. | |
| 5,605,016 | A * | 2/1997 | Pollard | E05D 15/0652 49/409 |
| 5,873,205 | A * | 2/1999 | Hanlon | E04B 2/7416 49/158 |
| 6,161,334 | A | 12/2000 | Goodin | |
| 6,202,729 | B1 | 3/2001 | Cunningham | |
| D626,661 | S | 11/2010 | Bertsch | |
| 2004/0003556 | A1* | 1/2004 | Zerbst | E04B 2/7422 52/220.7 |
| 2004/0148865 | A1* | 8/2004 | Duncan | E05B 1/0015 49/415 |
| 2005/0210749 | A1* | 9/2005 | DuBose | E05D 15/0665 49/118 |
| 2011/0113694 | A1* | 5/2011 | Douche | E06B 3/4654 49/425 |
| 2011/0126476 | A1* | 6/2011 | Bertram | E05D 15/0621 49/506 |
| 2014/0075863 | A1* | 3/2014 | Laronde | E06B 1/045 52/217 |
| 2016/0002966 | A1* | 1/2016 | Zhong | E05F 3/02 16/66 |
| 2016/0369547 | A1* | 12/2016 | Sato | E05F 1/16 |
| 2017/0362881 | A1* | 12/2017 | Gosling | E06B 3/4654 |

* cited by examiner

POCKET DOOR SYSTEM

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIE THE OFFICE ELECTRONIC FILING SYSTEM.

Not Applicable

STATEMENT REGARDING PRIOR DISCLOSURES BY THE INVENTOR OR JOINT INVENTOR

Not Applicable

BACKGROUND OF THE INVENTION (1) Field of the Invention (2) Description of Related Art Including Information Disclosed Under 37 CFR 1.97 and 1.98.

The disclosure and prior art relates to door devices and more particularly pertains to a new door device for inhibiting an animal from passing through a doorway.

BRIEF SUMMARY OF THE INVENTION

An embodiment of the disclosure meets the needs presented above by generally comprising a door frame is positioned within a wall. A door unit is slidably positioned within the wall. The door unit is biased into a closed position having the door unit extending across the door frame. Thus, the door unit may inhibit an animal from passing through the door frame. The door unit is selectively urged into an open position. Thus, the door unit facilitates the animal to pass through the door frame.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will from the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
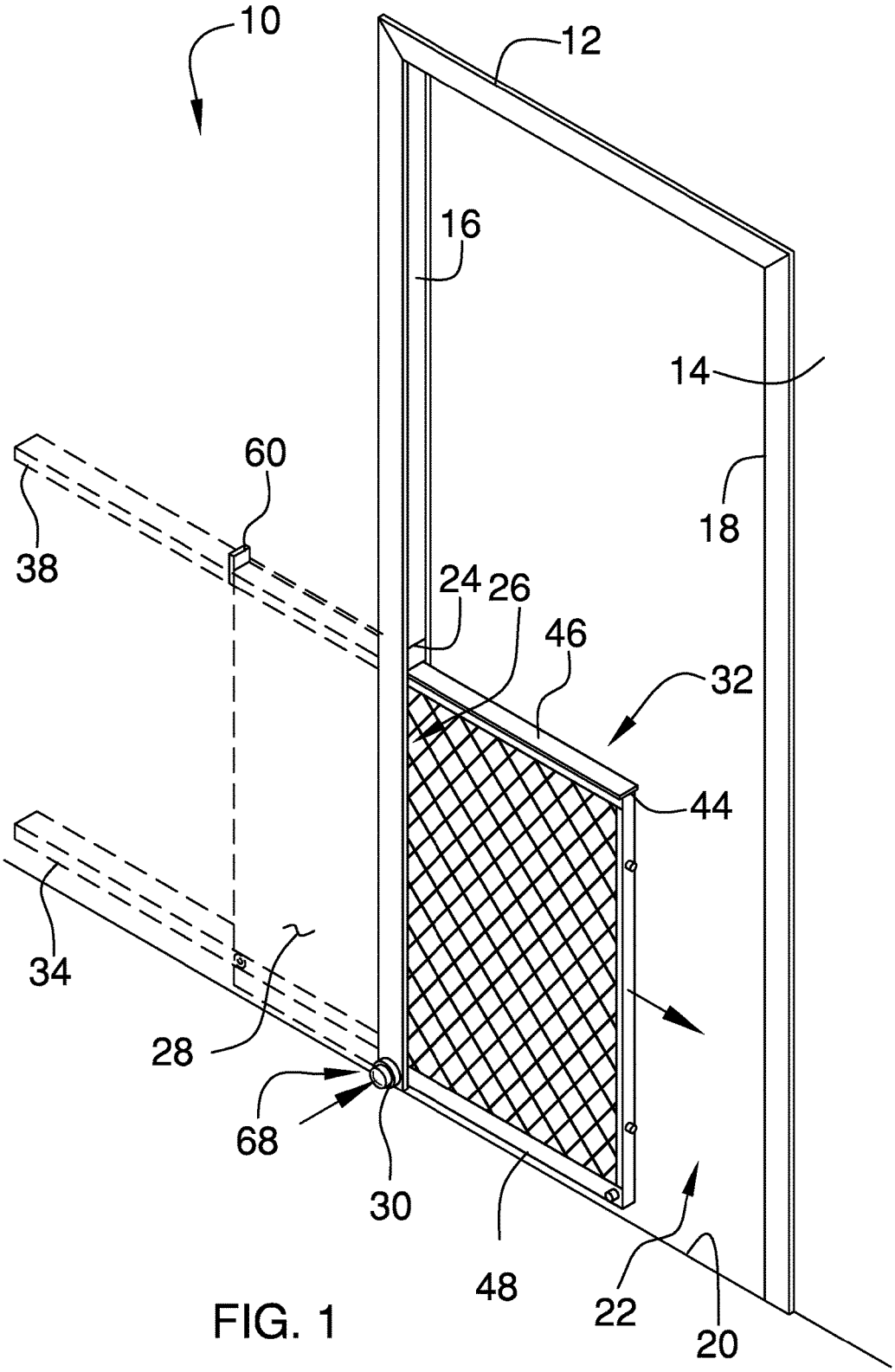
FIG. 1 is a perspective phantom view of a pocket door system according to an embodiment of the disclosure.
Figure 2:
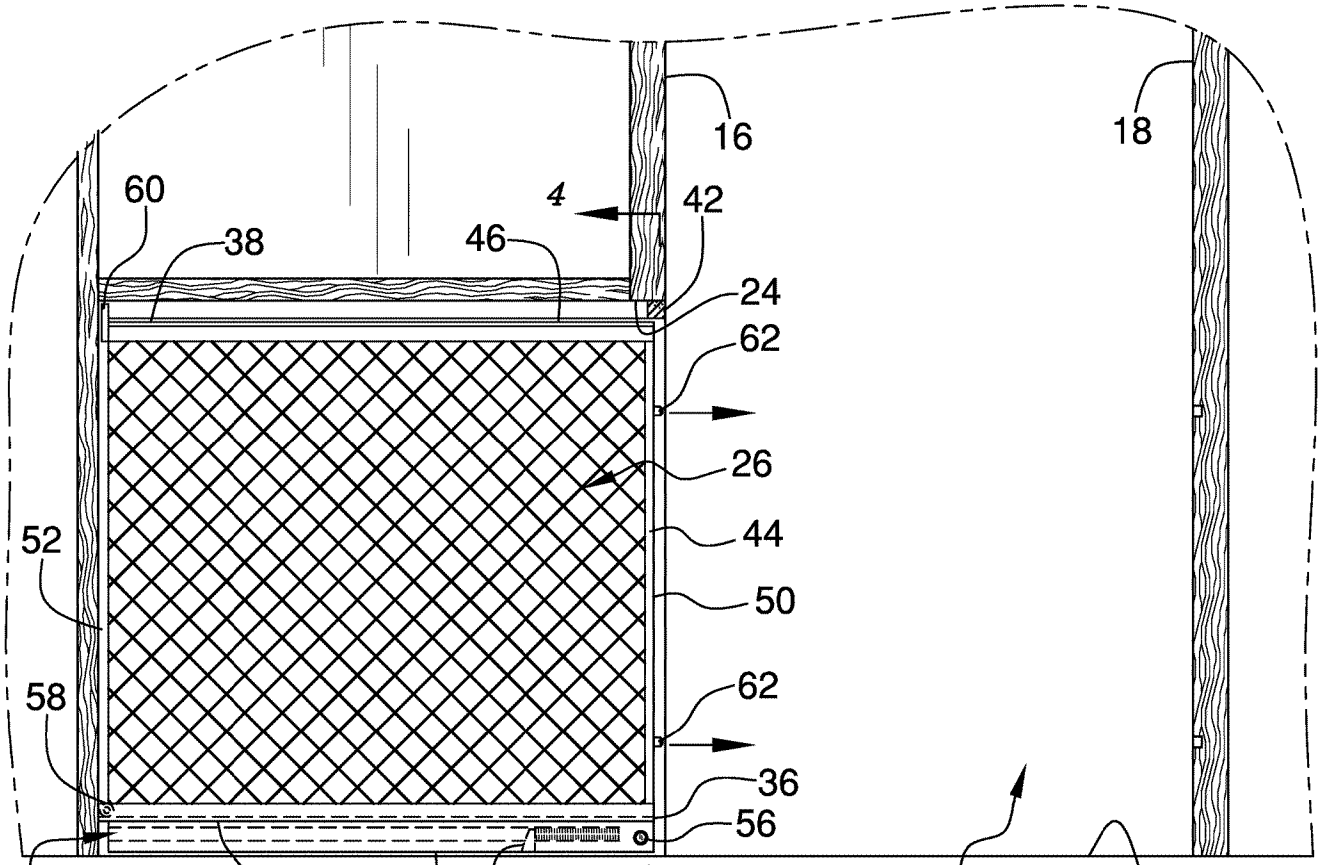
FIG. 2 is a front cut-away view of an embodiment of the disclosure in an open position.
Figure 3:
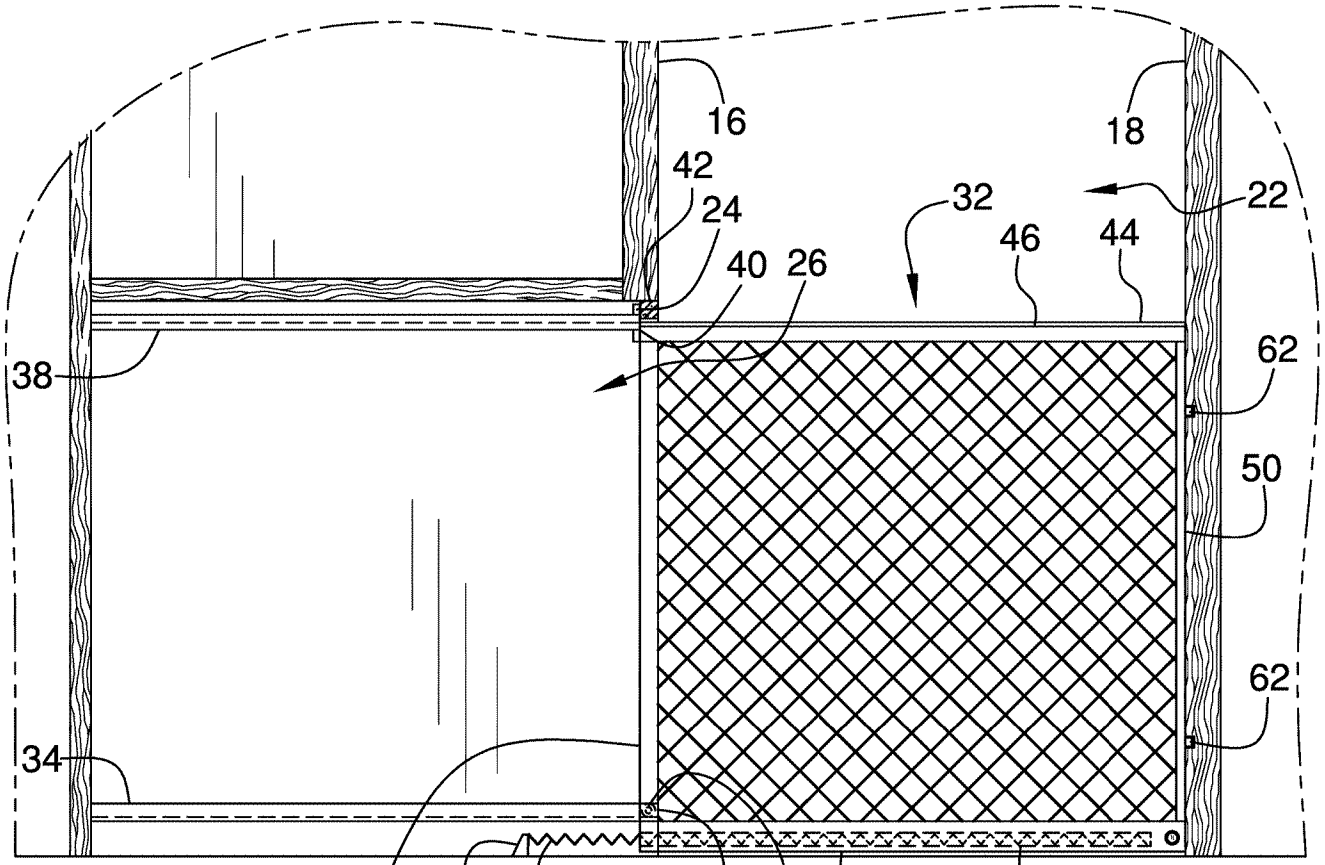
FIG. 3 is a front cut-away view of an embodiment of the disclosure in a closed position.
Figure 4:
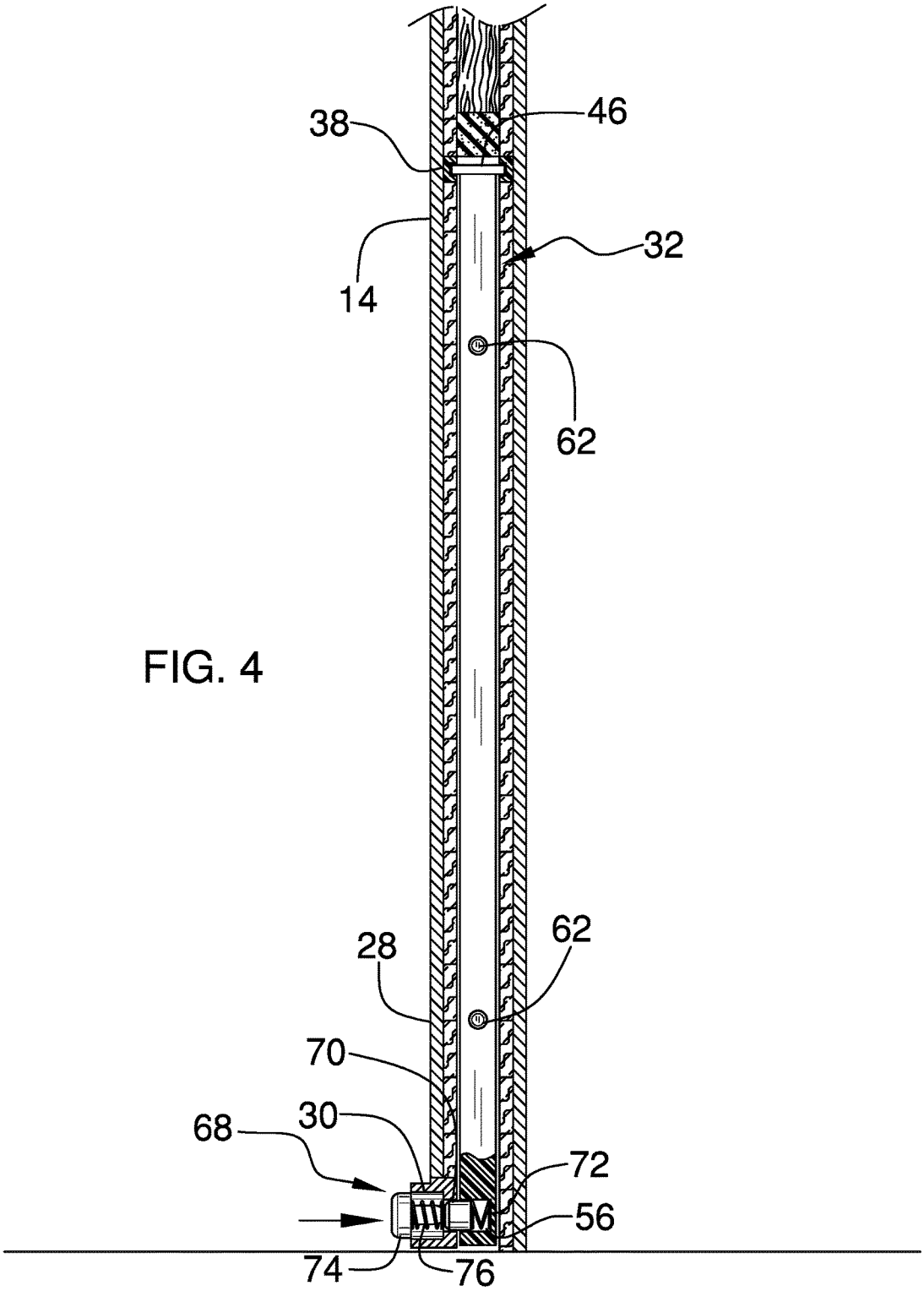
FIG. 4 is a cross sectional view taken along line 4-4 of FIG. 2 of an embodiment of the disclosure.

With reference now to the drawings, and in particular to FIGS. 1 through 4 thereof, a new door device embodying the principles and concepts of an embodiment of the disclosure and generally designated by the reference numeral 10 will be described.

As best illustrated in FIGS. 1 through 4, the pocket door system 10 generally comprises a door frame 12 that is positioned within a wall 14. The wall 14 may be positioned within a house or the like. The door frame 12 has a first lateral member 16 and a second lateral member 18. Each of the first lateral member 16 and the second lateral member 18 are vertically oriented. The second lateral member 18 extends upwardly from a floor 20.

The first lateral member 16 is spaced from the second lateral member 18 to define an opening 22 in the wall 14. The first lateral member 16 has a bottom end 24. The bottom end 24 is spaced from the floor 20 to define a slot 26 extending into the wall 14. The wall 14 has a first surface 28 and the first surface 28 has an aperture 30 extending into the slot 26. The aperture 30 is positioned adjacent to an intersection between the wall 14 and the floor 20.

A door unit 32 is provided and the door unit 32 is slidably positioned within the wall 14. The door unit 32 is biased into a closed position having the door unit 32 extending across the door frame 12. Thus, the door unit 32 may inhibit and animal from passing through the door frame 12. The animal may be a pet or the like. The door unit 32 is selectively urged into an open position. Thus, the door unit 32 facilitates the animal to pass through the door frame 12.

The door unit 32 comprises a first track 34. The first track 34 is concealed within the wall 14. The first track 34 is spaced from the floor 20 and the first track 34 has a terminal end 36. The terminal end 36 is aligned with the first lateral member 16 of the door frame 12.

A second track 38 is provided and the second track 38 is concealed within the wall 14. The second track 38 is spaced from the first track 34. The second track 38 has a terminal end 40. The terminal end 40 corresponding to the second track 38 is aligned with the first lateral member 16. A first stop 42 is coupled to the bottom end 24 of the first lateral member 16.

A gate 44 is provided. The gate 44 has a top side 46, a bottom side 48, a front side 50 and a back side 52. The top side 46 slidably engages the second track 38. The gate 44 is concealed within the wall 14 when the door unit 32 is positioned in the open position. The gate 44 extends across the door frame 12 when the door unit 32 is positioned in the closed position. Thus, the front side 50 engages the second lateral member 18. The gate 44 extends between the floor 20 and the bottom end 24 of the first lateral member 16.

The bottom side 48 has a first well 54 extending from the back side 52 toward the front side 50. The bottom side 48 has a second well 56 extending therein. The second well 56 is positioned adjacent to the front side 50. Moreover, the second well 56 is oriented perpendicular with respect to the first well 54.

A roller 58 is coupled to the back side 52 of the gate 44. The roller 58 rollably engages the first track 34. Thus, the first well 54 is positioned between the first track 34 and the floor 20. A tab 60 extends upwardly from the top side 46 of the gate 44. The tab 60 is aligned with the back side 52. The tab 60 engages the first stop 42 when the door unit 32 is positioned in the closed position. Thus, the tab 60 inhibits the gate 44 from being removed from the wall 14.

A pair of pins 62 is provided and each of the pins 62 is coupled to and extends away from the front side 50 of the gate 44. The pins 62 are spaced apart from each other. Each of the pins 62 engages the second lateral member 18 when the door unit 32 is positioned in the closed position. Thus, each of the pins 62 inhibits the gate 44 from being laterally deflected with respect the second lateral member 18.

A second stop 64 is coupled to and extends upwardly from the floor 20. The second stop 64 is positioned within the wall 14. The second stop 64 is aligned with the first track 34. The second stop 64 is spaced from the slot 26 in the wall 14.

A first biasing member 66 is positioned within the first well 54. The first biasing member 66 engages the second stop 64. The first biasing member 66 biases the gate 44 to extend across the door frame 12. The first biasing member 66 may comprise a spring or the like.

A lock 68 is provided. The lock 68 is coupled to the wall 14 and the lock 68 may be manipulated. The lock 68 is aligned with the slot 26. The lock 68 engages the gate 44 when the door unit 32 is positioned in the open position. Thus, the lock 68 retains the door unit 32 in the open position. The lock 68 selectively releases the gate 44 such that the first biasing member 66 biases the door unit 32 into the closed position.

The lock 68 comprises a post 70 that is slidably positioned within the second well 56. The post 70 engages the aperture 30 when the door unit 32 is positioned in the open position. Thus, the gate 44 is retained within the wall 14. A second biasing member 72 is positioned in the second well 56. The second biasing member 72 biases the post 70 to extend outwardly from the second well 56. The second biasing member 72 may comprise a spring or the like.

A knob 74 is slidably positioned within the aperture 30 in the wall 14. The knob 74 extends outwardly from the first surface 28 in the wall 14. Thus, the knob 74 may be manipulated. The knob 74 is urged inwardly with respect to the aperture 30. The knob 74 urges the post 70 outwardly from the aperture 30. Thus, the first biasing member 66 biases the door unit 32 into the closed position.

A third biasing member 76 is provided. The third biasing member 76 is positioned within the aperture 30. The third biasing member 76 biases the knob 74 to extend outwardly from the first surface 28 of the wall 14. The third biasing member 76 may comprise a spring or the like.

In use, the gate 44 is manually urged into the slot 26 to position the door unit 32 in the open position. The post 70 engages the aperture 30 and the gate 44 is retained within the wall 14. The knob 74 is manipulated to position the door unit 32 in the closed position. Thus, the first biasing member 66 biases the gate 44 to extend outwardly from the slot 26. Each of the pins 62 engages the second lateral member 18. Thus, the gate 44 inhibits the animal from passing through the door frame 12.

With respect to the above description then, it is to be realized that the optimum dimensional relationships for the parts of an embodiment enabled by the disclosure, to include variations in size, materials, shape, from, function and manner of operation, system and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A pocket door system comprising: a door frame being positioned within a wall, said door frame including a first lateral member and a second lateral member extending up from a floor; and a door unit being slidably positioned within said wall, said door unit being biased into a closed position having said door unit extending across said door frame wherein said door unit is configured to inhibit an animal from passing through said door frame, said door unit being selectively urged into an open position wherein said door unit is configured to facilitate the animal to pass through said door frame, said door unit comprising a first track being concealed within said wall, said first track being spaced from said floor, said first track having a terminal end, said terminal end being aligned with said first lateral member of said door frame, and a second track being concealed within said wall, said second track being spaced from said first track, said second track having a terminal end, said terminal end corresponding to said second track being aligned with said first lateral member, and a gate having a top side, a bottom side, a front side and a back side, said top side slidably engaging said second track, said gate being concealed within said wall when said door unit is positioned in said open position, said gate extending across said door frame when said door unit is positioned in said closed position having said front side engaging said second lateral member, said bottom side having a first well extending from said back side toward said front side, said bottom side having a second well extending into said bottom side, said second well being positioned adjacent to said front side, said second well being oriented perpendicular with respect to said first well, said system further comprising a roller being coupled to said back side of said gate, said roller rollably engaging said first track having said first well being positioned between said first track and said floor.

2. The system according to claim 1, wherein said first lateral member being spaced from said second lateral member to define an opening in said wall, said first lateral member having a bottom end, said bottom end being spaced from said floor to define a slot extending into said wall, said wall having a first surface, said first surface having an aperture extending into said slot.

3. The system according to claim 1, further comprising a first stop being coupled to a bottom end of said first lateral member.

4. The system according to claim 3, further comprising a tab extending upwardly from said top side of said gate, said tab being aligned with said back side, said tab engaging said first stop when said door unit is positioned in said closed position such that said tab inhibits said gate from being removed from said wall.

5. The system according to claim 3, further comprising: said wall having a slot; and a second stop being coupled to and extending upwardly from said floor, said second stop being positioned within said wall, said second stop being aligned with said first track.

6. The system according to claim 5, further comprising: a first biasing member being positioned within said first well, said first biasing member engaging said second stop, said first biasing member biasing said gate to extend across said door frame.

7. The system according to claim 6, further comprising: a lock being coupled to said wall wherein said lock is configured to be manipulated, said lock being aligned with said slot, said lock engaging said gate when said door unit is positioned in said open position such that said lock retains said door unit in said open position, said lock selectively releasing said gate such that said first biasing member biases said door unit into said closed position.

8. The system according to claim 7, wherein:

said wall has a first surface, said first surface having an aperture extending inwardly therein; and said lock comprises a post being slidably positioned within said second well, said post engaging said aperture when said door unit is positioned in said open position such that said gate is retained within said wall.

9. A pocket door system comprising:

a door frame being positioned within a wall, said door frame including a first lateral member and a second lateral member; and a door unit being slidably positioned within said wall, said door unit being biased into a closed position having said door unit extending across said door frame wherein said door unit is configured to inhibit an animal from passing through said door frame, said door unit being selectively urged into an open position wherein said door unit is configured to facilitate the animal to pass through said door frame, said door unit comprising a first track being concealed within said wall, said first track being spaced from said floor, said first track having a terminal end, said terminal end being aligned with said first lateral member of said door frame, and a second track being concealed within said wall, said second track being spaced from said first track, said second track having a terminal end, said terminal end corresponding to said second track being aligned with said first lateral member, and a gate having a top side, a bottom side, a front side and a back side, said top side slidably engaging said second track, said gate being concealed within said wall when said door unit is positioned in said open position, said gate extending across said door frame when said door unit is positioned in said closed position having said front side engaging said second lateral member, said bottom side having a first well extending from said back side toward said front side, said bottom side having a second well extending therein, said second well being positioned adjacent to said front side, said second well being oriented perpendicular with respect to said first well, and a pair of pins, each of said pins being coupled to and extending away from said front side of said gate, said pins being spaced apart from each other, each of said pins engaging said second lateral member when said door unit is positioned in said closed position such that each of said pins inhibits said gate from being laterally deflected with respect said second lateral member.

10. A pocket door system comprising:

a door frame being positioned within a wall, said wall having a slot; and a door unit being slidably positioned within said wall, said door unit being biased into a closed position having said door unit extending across said door frame wherein said door unit is configured to inhibit an animal from passing through said door frame, said door unit being selectively urged into an open position wherein said door unit is configured to facilitate the animal to pass through said door frame;

a gate being movably positioned within said wall; and a lock being coupled to said wall wherein said lock is configured to be manipulated, said lock being aligned with said slot, said lock engaging said gate when said door unit is positioned in said open position such that said lock retains said door unit in said open position, said lock selectively releasing said gate such that a first biasing member biases said door unit into said closed position; said gate has a first well and a second well;

said wall has a first surface, said first surface having an aperture extending inwardly therein;

said lock comprises a post being slidably positioned within said second well, said post engaging said aperture when said door unit is positioned in said open position such that said gate is retained within said wall;

a second biasing member being positioned in said second well such that said second biasing member biases said post to extend outwardly from said second well.

11. A pocket door system comprising:

a door frame being positioned within a wall, said wall having a slot; and a door unit being slidably positioned within said wall, said door unit being biased into a closed position having said door unit extending across said door frame wherein said door unit is configured to inhibit an animal from passing through said door frame, said door unit being selectively urged into an open position wherein said door unit is configured to facilitate the animal to pass through said door frame;

a gate being movably positioned within said wall;

a lock being coupled to said wall wherein said lock is configured to be manipulated, said lock being aligned with said slot, said lock engaging said gate when said door unit is positioned in said open position such that said lock retains said door unit in said open position, said lock selectively releasing said gate such that a first biasing member biases said door unit into said closed position; said gate has a first well and a second well;

said wall has a first surface, said first surface having an aperture extending inwardly therein;

said lock comprises a post being slidably positioned within said second well, said post engaging said aperture when said door unit is positioned in said open position such that said gate is retained within said wall; and a knob being slidably positioned within said aperture in said wall having said knob extending outwardly from said first surface in said wall wherein said knob is configured to be manipulated, said knob being urged inwardly with respect to said aperture having said knob urging said post outwardly from said aperture such that said first biasing member biases said door unit into said closed position.

12. The system according to claim 11, further comprising a second biasing member and a third biasing member being positioned within said aperture, said third biasing member biasing said knob to extend outwardly from said first surface of said wall.

13. A pocket door system comprising:

a door frame being positioned within a wall, said door frame having a first lateral member and a second lateral member, said second lateral member extending upwardly from a floor, said first lateral member being spaced from said second lateral member to define an opening in said wall, said first lateral member having a bottom end, said bottom end being spaced from said floor to define a slot extending into said wall, said wall having a first surface, said first surface having an aperture extending into said slot; and a door unit being slidably positioned within said wall, said door unit being biased into a closed position having said door unit extending across said door frame wherein said door unit is configured to inhibit an animal from passing through said door frame, said door unit being selectively urged into an open position wherein said door unit is configured to facilitate the animal to pass through said door frame, said door unit comprising:

a first track being concealed within said wall, said first track being spaced from said floor, said first track having a terminal end, said terminal end being aligned with said first lateral member of said door frame, a second track being concealed within said wall, said second track being spaced from said first track, said second track having a terminal end, said terminal end corresponding to said second track being aligned with said first lateral member, a first stop being coupled to said bottom end of said first lateral member, a gate having a top side, a bottom side, a front side and a back side, said top side slidably engaging said second track, said gate being concealed within said wall when said door unit is positioned in said open position, said gate extending across said door frame when said door unit is positioned in said closed position having said front side engaging said second lateral member, said bottom side having a first well extending from said back side toward said front side, said bottom side having a second well extending therein, said second well being positioned adjacent to said front side, said second well being oriented perpendicular with respect to said first well, a roller being coupled to said back side of said gate, said roller rollably engaging said first track having said first well being positioned between said first track and said floor, a tab extending upwardly from said top side of said gate, said tab being aligned with said back side, said tab engaging said first stop when said door unit is positioned in said closed position such that said tab inhibits said gate from being removed from said wall, a pair of pins, each of said pins being coupled to and extending away from said front side of said gate, said pins being spaced apart from each other, each of said pins engaging said second lateral member when said door unit is positioned in said closed position such that each of said pins inhibits said gate from being laterally deflected with respect said second lateral member, a second stop being coupled to and extending upwardly from said floor, said second stop being positioned within said wall, said second stop being aligned with said first track a first biasing member being positioned within said first well, said first biasing member engaging said second stop, said first biasing member biasing said gate to extend across said door frame, and a lock being coupled to said wall wherein said lock is configured to be manipulated, said lock being aligned with said slot, said lock engaging said gate when said door unit is positioned in said open position such that said lock retains said door unit in said open position, said lock selectively releasing said gate such that said first biasing member biases said door unit into said closed position, said lock comprising:

a post being slidably positioned within said second well, said post engaging said aperture when said door unit is positioned in said open position such that said gate is retained within said wall, a second biasing member being positioned in said second well such that said second biasing member biases said post to extend outwardly from said second well, a knob being slidably positioned within said aperture in said wall having said knob extending outwardly from said first surface in said wall wherein said knob is configured to be manipulated, said knob being urged inwardly with respect to said aperture having said knob urging said post outwardly from said aperture such that said first biasing member biases said door unit into said closed position, and a third biasing member being positioned within said aperture, said third biasing member biasing said knob to extend outwardly from said first surface of said wall.

* * * * *